United States Patent [19]

Anthony et al.

[11] 4,425,688

[45] Jan. 17, 1984

[54] CHILD BELT BUCKLE

[75] Inventors: James R. Anthony, Indianapolis; Allan R. Lortz, Carmel, both of Ind.

[73] Assignee: Indiana Mills & Manufacturing, Inc., Carmel, Ind.

[21] Appl. No.: 318,757

[22] Filed: Nov. 6, 1981

[51] Int. Cl.[3] ..... A44B 19/00

[52] U.S. Cl. ..... 24/656; 24/664

[58] Field of Search ..... 24/230 AL, 230 A, 230 R, 24/230 AK, 230 AP, 230 AS, 230 AT, 307, 163 K, 163 R, 164, 165

[56] References Cited

U.S. PATENT DOCUMENTS

| | | | |
|---|---|---|---|
| 3,760,467 | 9/1973 | Lohr | 24/230 AL |
| 3,807,000 | 4/1974 | Weman | 24/230 AL |
| 3,921,262 | 11/1975 | Tanaka | 24/230 A |
| 4,052,773 | 10/1977 | Nesbitt | 24/163 K |
| 4,170,808 | 10/1979 | Knowles | 24/163 K |
| 4,196,500 | 4/1980 | Happel et al. | 24/230 AL |

*Primary Examiner*—Gene Mancene
*Assistant Examiner*—Kris R. Schulze
*Attorney, Agent, or Firm*—Woodard, Weikart, Emhardt & Naughton

[57] ABSTRACT

A buckle for receiving a tongue. A pair of helical springs are positioned between the latch and a main body having first slots for receiving one edge of a reinforcement plate which is pivoted downward depressing the latch springs and snapping into place into a yieldable hook shaped portion. A push button is positioned between the reinforcement plate and the cover which has a plurality of downwardly extending hook shaped fingers engaging the plate which secures the cover and main body together.

14 Claims, 6 Drawing Figures

CHILD BELT BUCKLE

BACKGROUND OF THE INVENTION

A variety of seat belt buckles have been devised to maximize holding capability as well as to improve the cost and ease of manufacture. For example, the U.S. Pat. No. 4,196,500 issued to Herman E. Happel and James R. Anthony discloses a buckle having a reinforcing plate attached to the cover and main body for strengthening the buckle. The buckle includes a spring biased latch urged upwardly to lockinging receive a seat belt tongue.

In the case of a buckle to be used for securing a child, the amount of spring force required to urge the latch to the locking position is considerably greater as compared to the regular adult buckle. As a result, the assembly of such a buckle becomes exceptionally difficult since the various components must be held together during the final fastening operation. Disclosed herein is a buckle having means for allowing the reinforcement plate to be snapped into position in the main body prior to assembly of the cover to the main body. Further, the cover is attached directly to the reinforcement plate thereby directing all of the assembly force into the plate in lieu of the main body.

SUMMARY OF THE INVENTION

One embodiment of the present invention is a buckle comprising a reinforcement plate, a main body having the plate mounted thereto, the main body includes yieldable means integral therewith being movable to allow the plate to be inserted in the main body and then movable back holding the plate therein, a latch positioned in the main body and held captive therein by the plate, the latch movable between a latch position and an unlatched position, spring means contacting the latch to move the latch back and forth between the latch position and the unlatched position, and operator means operable to move the latch to the unlatching position.

Another embodiment of the present invention is a buckle lockingly engagable with a tongue comprising a main body, a reinforcement plate mounted to the main body, a latch positioned in the main body and held captive therein by the plate, spring means positioned in the main body and contactable with the latch being operable to move the latch, operator means operably engaged with the latch for movement thereof, and a cover hookingly engaged with the plate securing the cover to the main body.

It is an object of the present invention to provide a buckle having greater than normal latching force which is relatively easy to assemble.

A further object of the present invention is to provide a buckle having a reinforcement plate to which the cover and main body are secured.

Yet another object of the present is to provide a new and improved buckle.

Related objects and advantages of the present invention will be apparent from the following description.

DESCRIPTION OF THE PREFERRED EMBODIMENT

Figure 1:
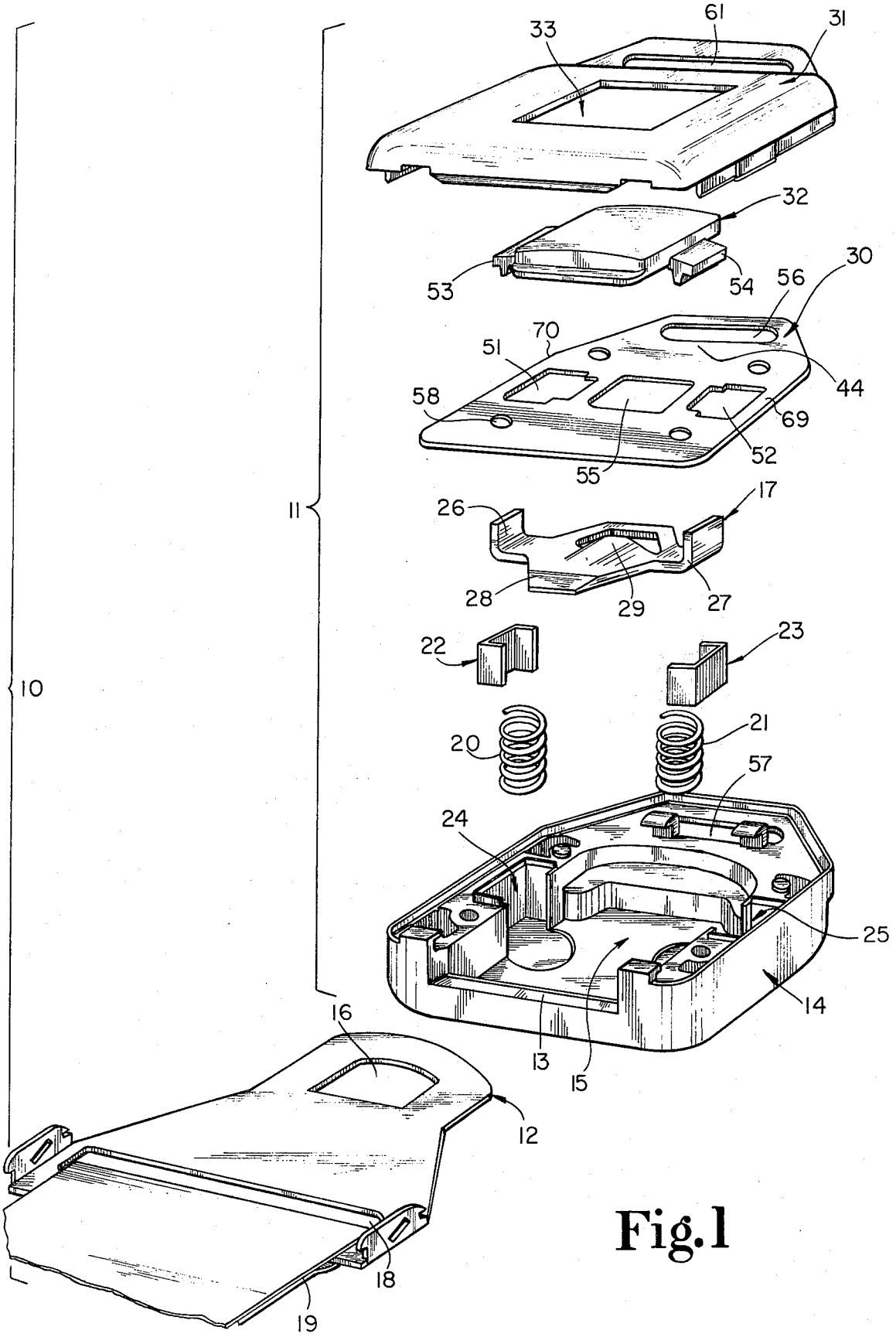
FIG. 1 is an exploded perspective view of the buckle and tongue combination incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a buckle tongue combination 10 consisting of a buckle 11 shown in exploded view and a buckle tongue 12. Buckle 11 includes a main body 14 having a mouth 13 for receiving the leading edge of tongue 12 which extends into a cavity 15 formed in main body 14. Tounge 12 includes an aperture 16 through which an upraised portion of latch 17 projects. Tounge 12 includes a second aperture 18 with web 19 extending therethrough and being fixedly attached to the tongue. A pair of helical springs 20 and 21 rest within cavity 15 and urge latch 17 to the upward position whereat the latch is locked to tongue 12. A pair of channels 22 and 23 are secured within complementary sized cavities 24 and 25 opening into main cavity 15. Channels 22 and 23 slidably receive the mutually opposed and upturned arms 26 and 27 of latch 17. The forward edge 28 of latch 17 is beveled downwardly to guide tongue 12 toward the upraised portion 29 which is extendable through aperture 16. Springs 20 and 21 are positioned between the bottom wall of main body 14 forming cavity 15 and the undersurface of latch 17. A reinforcement plate 30 is attached to main body 14 and in turn is attached to cover 31 with a push button 32 located between cover 31 and plate 30 and projectable partially through aperture 33 of cover 31 to allow the operator to depress the button thereby depressing latch 17 to the downward or unlocked position.

Figure 2:
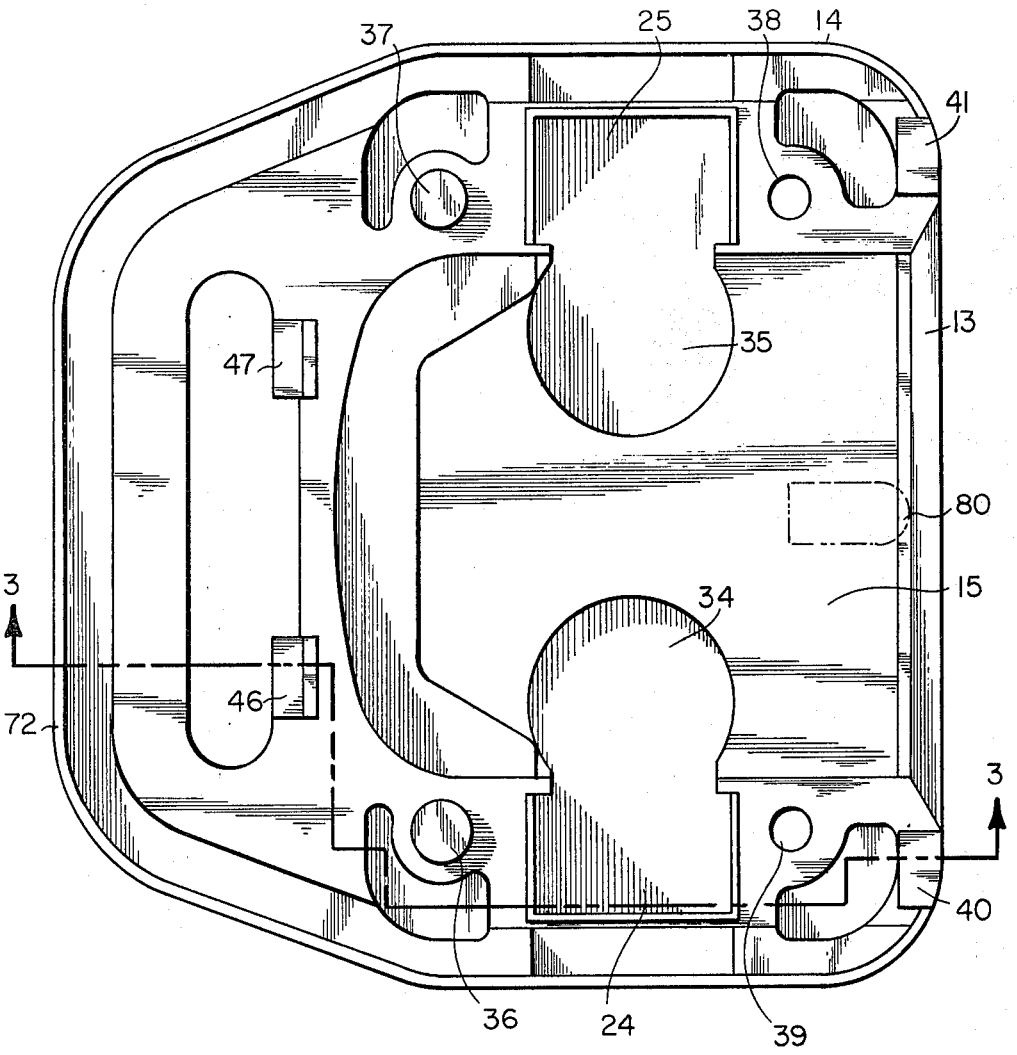
FIG. 2 is a top view of the main body of the buckle.
Figure 3:
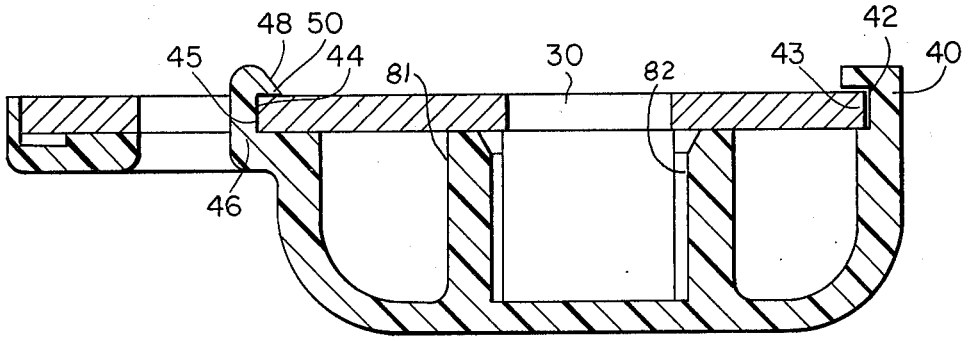
FIG. 3 is a cross-sectional view viewed in the direction of the arrows 3—3 of FIG. 2 showing the reinforcement plate in position.

Main body 14 (FIG. 2) may be made from a material such as plastic. Main body 13 includes a pair of spring cavities 34 and 35 opening respectively into the channel receiving cavities 24 and 25. A pair of conventional helical springs 20 and 21 (FIG. 1) are positioned within cavities 34 and 35 contacting the bottom surface of latch 17. Optional pins 36 through 39 are secured to main body 13 and extend upwardly through plate 30 and into cover 31. Positioned on the opposite sides of mouth 13 are a pair of upwardly extending arms 40 and 41 having an aligned channel 42 (FIG. 3) facing and opening rearwardly. The leading edge 43 of plate 30 is first inserted into channels 42 and then pivoted downwardly thereby forcing the latch downward compressing springs 20 and 21 until edge portion 44 snaps into the pair of forward facing and opening grooves 45 provided in upstanding arms 46 and 47. Each arm 46 and 47 is sufficiently flexible to move outwardly when the leading edge 44 contacts the cam surface 48 of each arm. Further pivoting downward of the bracket of plate 30 into grooves 45 allows arms 46 and 47 to move back to their original position securing the plate in its final resting position. Each arm 46 and 47 has a top hook shaped edge 50 which overlaps the top surface of plate 30 securing the plate in the grooves. Additional support means or walls 81 and 82, located between grooves 42 and 45, project up from main body 14 and support plate 30.

Plate 30 (FIG. 1) includes a pair of apertures 51 and 52 aligned with cavities 24 and 25 to receive the downwardly extending button legs 53 and 54 which project through the plate contacting the upwardly extending arms 26 and 27 of latch 17. Further, a third aperture 55 is provided in plate 30 between apertures 51 and 52 to allow the upward raised portion 29 of the latch to engage aperture 16 of tongue 12. A fourth aperture 56 is formed rearwardly of edge 44 and is aligned with aperture 57 of main body 14 and aperture 61 of cover 31 to allow a seat belt to be attached to the buckle. A plurality of apertures 58 are located around the peripheral portion of plate 30 to receive a plurality of pins extending through the plate and into main body 14 and cover 31 to provide additional strengthening means securing the cover, plate and main body together.

Figure 4:
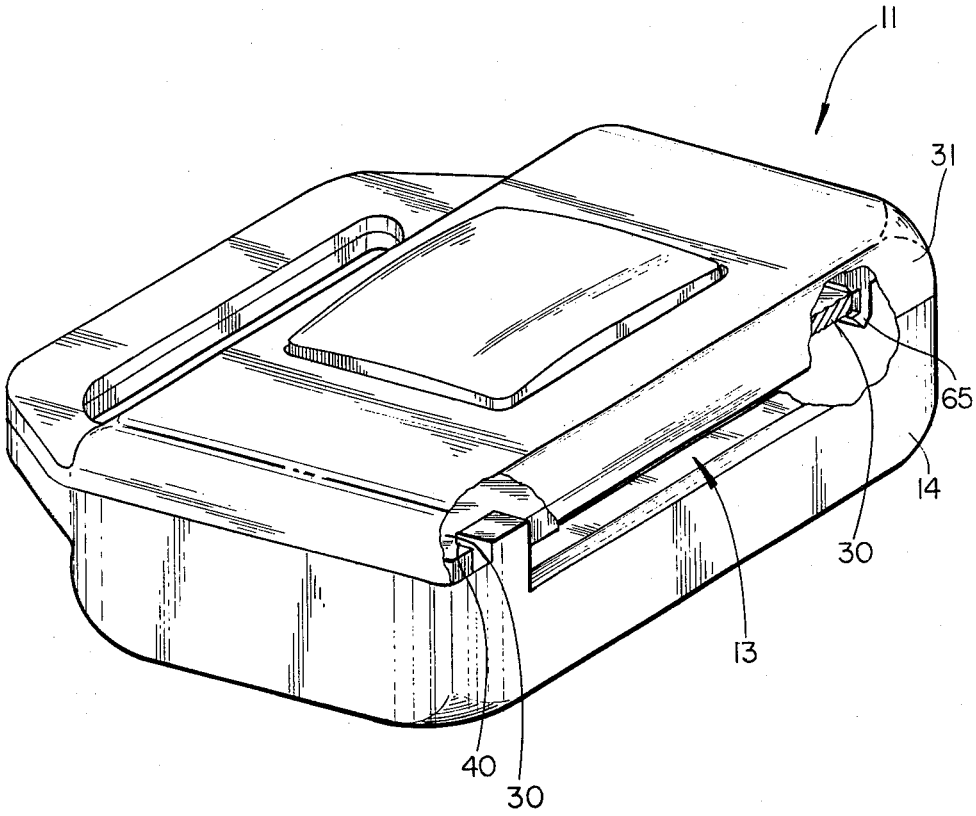
FIG. 4 is a fragmentary perspective view of the buckle of FIG. 1 showing the attachment of the cover and main body to the reinforcement plate.
Figure 5:
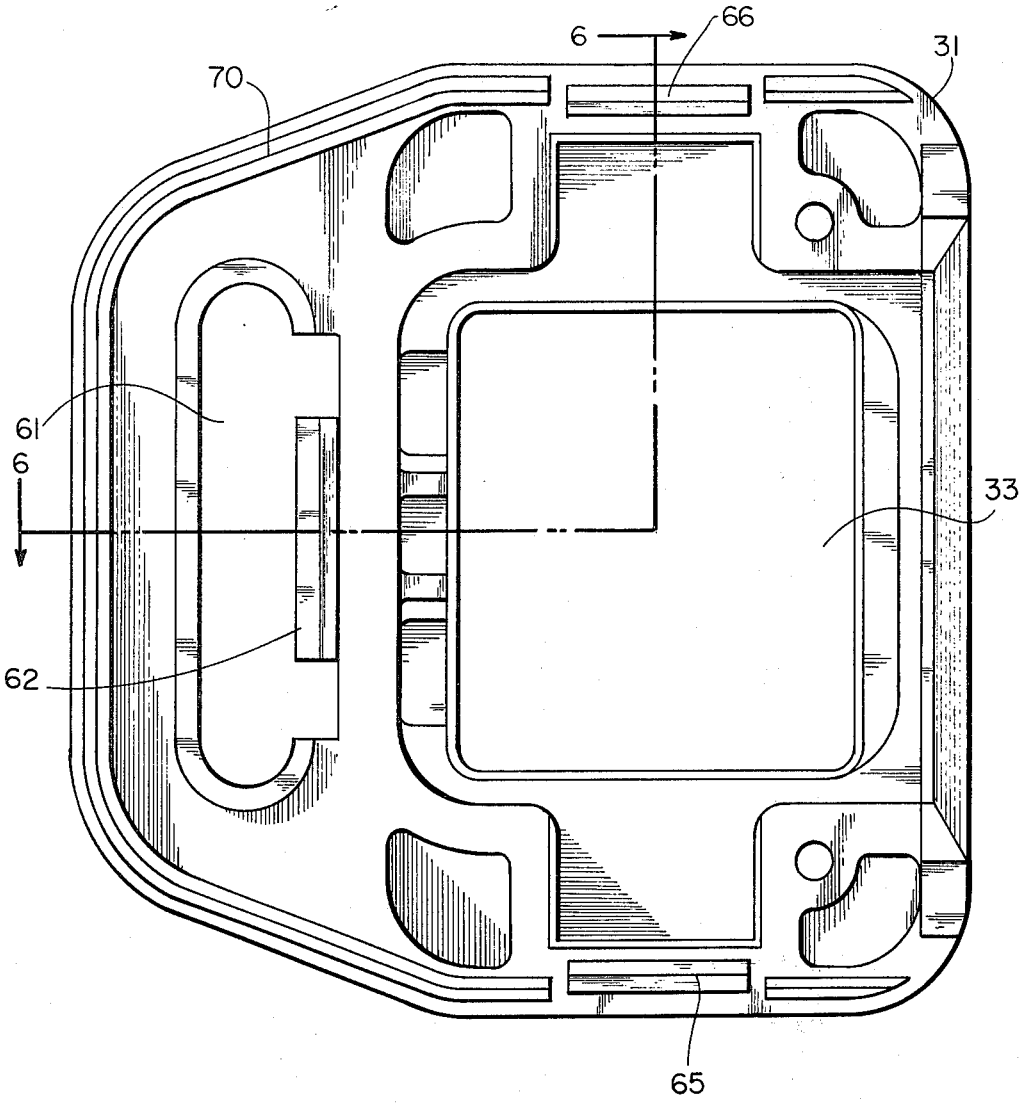
FIG. 5 is a bottom view of the buckle cover.
Figure 6:
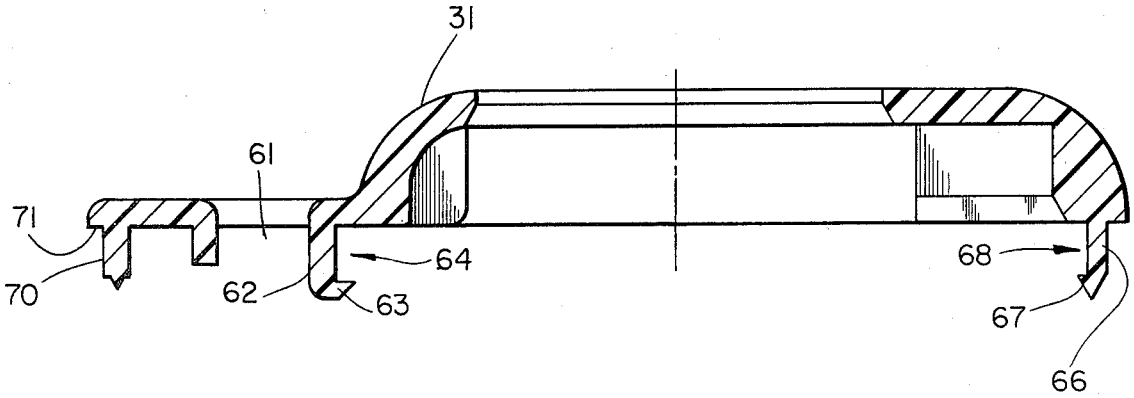
FIG. 6 is a cross-sectional view and viewed in the direction of the arrows 6—6 of FIG. 5.

Cover 31 is snapped onto and held to plate 30 by a plurality of downwardly extending hook shaped extensions. Extension 62 (FIGS. 5 and 6) extends downwardly from the cover and is located immediately forward of aperture 61 having a forwardly extending portion 63 forming a groove 64 to receive edge portion 44 of plate 30. Extension 62 when snapped onto plate 30 is positioned between the upwardly extending arms 46 and 47 (FIG. 2) of main body 14. A pair of downwardly extending hook shaped extensions 65 and 66 are provided on cover 31 with each including a rearwardly extending portion 67 (FIG. 6) forming a slot 68 to receive respectively the edge portions 69 and 70 (FIG. 1) immediately adjacent apertures 52 and 51. A fragmentary front perspective view of buckle 11 is shown in FIG. 4 illustrating the mounting of plate 30 to one of the upwardly extending arms 40 of main body 14 while simultaneously being mounted to one of the downwardly extending extensions 65 of cover 31.

Ridge 70 extends around the periphery of cover 31 starting immediately rearwardly of extension 66 and around aperture 61 to immediately rearward of extension 65 thereby spacing apart the interior surface of cover 31 from the upwardly facing surface of main body 14 and allowing the downwardly extending hook shaped extensions to engage plate 30. Ridge 70 (FIG. 6) is spaced inwardly from the outer edge of the cover forming a ledge 71 to receive an upwardly extending ridge 72 (FIG. 2) extending around the circumference of the main body with the exception that the ridge does not extend between arms 41 and 40 at the location of mouth 13. A suitable fastening method, such a as sonic welding, may be used to bond ridge 70 to ridge 72.

Many variations are contemplated and included in the present invention. For example, a tongue separated into two pieces may be utilized in lieu of the single tongue 12 shown in FIG. 1. In such a case, a partition wall 80 extends upwardly from the bottom wall of main body 14 (FIG. 2) being located at the midpoint of mouth 13. The partition wall 80 is shown in dashed lines to illustrate that it should be removed in case a single tongue 12 is utilized as depicted in FIG. 1. Further, a downward extension is provided on push button 32 to further divide mouth 13 into two separate equal parts in a case a dual tongue is utilized. The downward extension is not provided on the push button in case a single tongue is provided. An additional helical spring may be utilized with springs 20 and 21 to further increase the amount of spring force. In such a case, the third spring would be located between and rearwardly of springs 20 and 21.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A buckle comprising:

a reinforcement plate;

a main body having said plate mounted thereto, said main body includes yieldable means integral therewith for engaging said plate, said yieldable means being movable to allow said plate to be inserted in said main body and then movable back holding said plate therein;

a latch positioned in said main body and held captive therein by said plate, said latch movable between a latch position and an unlatched position;

spring means contacting said latch to move said latch back and forth between said latch position and said unlatched position;

operator means operable to move said latch to said unlatching position; and a cover mounted to said main body and enclosing said latch, said spring means and said plate, said cover including locking means engaging said plate securing said cover to said main body.

2. The buckle of claim 1 wherein said main body includes an internal groove mountingly receiving one end of said plate, said yieldable means includes a hook shaped portion forming a second groove aligned with said internal groove and receiving an other end of said plate opposite said one end.

3. The buckle of claim 2 wherein said hook shaped portion has a cam surface contactable by said other end of said plate moving said hook shaped portion outwardly as said plate is intially inserted into said internal groove and pivoted into said second groove.

4. The buckle of claim 3 wherein said main body includes additional support means between said internal groove and said second groove contacting and supporting said plate.

5. The buckle of claim 1 and wherein said cover includes an outwardly extending hook shaped finger hookingly engaging said plate.

6. The buckle of claim 5 wherein said cover includes a plurality of hook shaped fingers engaging edge portions of said plate.

7. The buckle of claim 5 wherein said main body includes an internal groove mountingly receiving one end of said plate, said yieldable means includes a hook shaped portion forming a second groove aligned with said internal groove and receiving an other end of said plate opposite said one end.

8. The buckle of claim 7 wherein said hook shaped portion has a cam surface contactable by said other end of said plate moving said hook shaped portion outwardly as said plate is intially inserted into said internal groove and pivoted into said second groove.

9. The buckle of claim 8 and further comprising a pair of opposed channels inserted in said main body slidably receiving opposite ends of said latch.

10. The buckle of claim 1 wherein said main body forms a tongue receiving cavity including a partition dividing said cavity into a dual tongue receiving cavity.

11. A buckle lockingly engagable with a tongue comprising:

a reinforcement plate having opposite end portions;

a main body having said plate mounted thereto, said main body having locking means integral therewith and engaging said opposite end positions of said plate securing said plate thereto;

a latch positioned in said main body and held captive therein by said plate;

spring means positioned in said main body and contactable with said latch being operable to move said latch;

operator means operably engaged with said latch for movement thereof; and a cover hookingly engaged with said plate securing said cover to said main body.

12. The buckle of claim 11 wherein said main body includes a first end with a first slot therein and a second end portion opposite said first end with a yieldable portion defining a second slot;

said plate has a first edge positioned in said first slot, said plate upon initial installation on said main body being pivoted about said first edge past said yieldable portion compressing said spring means and snapping into place in said second slot.

13. The buckle of claim 11 wherein said main body is hookingly engaged with said plate securing said plate thereto.

14. The buckle of claim 13 wherein said plate includes opposite side portions and a rear portion, said cover includes a pair of opposed hook shaped fingers engaged with said opposite side portions and a rear hook shaped portion engaged with said rear portion.

* * * * *

UNITED STATES PATENT AND TRADEMARK OFFICE

CERTIFICATE OF CORRECTION

PATENT NO. : 4,425,688

DATED : January 17, 1984

INVENTOR(S) : James R. Anthony and Allan R. Lortz

It is certified that error appears in the above-identified patent and that said Letters Patent are hereby corrected as shown below:

In column 5, line 14, "positions" should read --portions--.

Signed and Sealed this

*Tenth* Day of *April 1984*

[SEAL]

*Attest:*

GERALD J. MOSSINGHOFF

*Attesting Officer*

*Commissioner of Patents and Trademarks*